US011408574B2

(12) United States Patent
Hunt et al.

(10) Patent No.: US 11,408,574 B2
(45) Date of Patent: Aug. 9, 2022

(54) CARD EDGE CONNECTOR FOR A LIGHTING MODULE

(71) Applicant: Valeo North America, Inc., Seymour, IN (US)

(72) Inventors: Brian Jeffrey Hunt, Columbus, IN (US); Jonathan Blandin, Columbus, IN (US)

(73) Assignee: Valeo North America, Inc., Seymour, IN (US)

( * ) Notice: Subject to any disclaimer, the term of this patent is extended or adjusted under 35 U.S.C. 154(b) by 0 days.

(21) Appl. No.: 17/144,489

(22) Filed: Jan. 8, 2021

(65) Prior Publication Data

US 2021/0131631 A1 May 6, 2021

Related U.S. Application Data

(63) Continuation of application No. 16/833,725, filed on Mar. 30, 2020, now Pat. No. 10,928,027, which is a (Continued)

(51) Int. Cl.
*F21V 1/00* (2006.01)
*F21S 41/19* (2018.01)
(Continued)

(52) U.S. Cl.
CPC ..... *F21S 41/198* (2018.01); *F21S 41/192* (2018.01); *F21S 41/30* (2018.01); *F21S 45/00* (2018.01);
(Continued)

(58) Field of Classification Search
CPC ..... F21S 41/198; F21S 45/00; F21S 41/192; F21S 41/30; F21S 45/47; F21S 43/19;
(Continued)

(56) References Cited

U.S. PATENT DOCUMENTS 3,899,234 A 8/1975 Yeager et al.
3,970,353 A 7/1976 Kaufman
(Continued)

FOREIGN PATENT DOCUMENTS

CN 2891370 4/2007
WO WO-2011078217 A1 * 6/2011 ..... F21K 9/20

OTHER PUBLICATIONS

IP.com English translation of WO 2011/078217 A1 (Year: 2011).*

*Primary Examiner* — Omar Rojas Cadima
(74) *Attorney, Agent, or Firm* — Oblon, McClelland, Maier & Neustadt, L.L.P.

(57) ABSTRACT

A lamp assembly for a vehicle comprising a housing, a reflector mounted in the housing, a light source, a printed circuit board or PCB mounted on a heatsink of the lamp assembly and coupled to the light source to control operation of the light source. The PCB has a first connector for coupling to a second connector comprising a body having a plurality of resilient or elastic arms that each have a detent for locking the connector to the component and retain electrical contact with the PCB. The wall of the heatsink defines an aperture for receiving the second connector and provides a locking surface that deflects the arms towards the body while engaging and cooperating with the detents to lock the connector to the PCB. The free end of the arms extend beyond the mounting wall and are actuated to unlock the connector from the PCB.

20 Claims, 5 Drawing Sheets

Related U.S. Application Data continuation of application No. 15/474,287, filed on Mar. 30, 2017, now Pat. No. 10,655,810.

(51) Int. Cl.

| | |
|---|---|
| ***F21S 41/30*** | (2018.01) |
| ***F21S 45/47*** | (2018.01) |
| ***F21S 45/00*** | (2018.01) |
| ***H01R 13/74*** | (2006.01) |
| *H01R 12/71* | (2011.01) |

(52) U.S. Cl.

CPC ..... *F21S 45/47* (2018.01); *H01R 13/743* (2013.01); *H01R 12/714* (2013.01)

(58) Field of Classification Search

CPC ..... F21S 43/195; F21S 41/196; F21S 41/19; F21S 45/49; H01R 13/743; H01R 12/714; H01R 13/6272; H01R 13/6273; H01R 13/74; H01R 12/70; H01R 33/94; H01R 33/975; H01L 23/40; H01L 33/486; H01L 23/32; H01L 23/34; F21V 23/06; F21V 17/005; F21V 19/003; F21V 21/088; H05K 2201/10189; H05K 3/325; H05K 2201/10962; H05B 31/0042; H05B 31/18; H05B 31/24

USPC ..... 362/546–549, 655, 373–374

See application file for complete search history.

(56) References Cited

U.S. PATENT DOCUMENTS

| | | | | |
|---|---|---|---|---|
| 4,487,468 | A | 12/1984 | Fedder et al. | |
| 8,241,044 | B2 * | 8/2012 | Mostoller ..... | F21K 9/00 439/56 |
| 8,851,916 | B2 | 10/2014 | Chen | |
| 9,267,659 | B2 * | 2/2016 | Lee ..... | F21S 43/195 |
| 10,581,187 | B2 * | 3/2020 | Pucher ..... | H01R 13/2421 |
| 2010/0167570 | A1 * | 7/2010 | Yang ..... | H01R 12/7023 439/325 |
| 2010/0302777 | A1 | 12/2010 | Knoll et al. | |
| 2011/0019398 | A1 * | 1/2011 | Bishop ..... | H05K 1/142 362/225 |
| 2013/0088880 | A1 | 4/2013 | Duan et al. | |
| 2013/0309892 | A1 | 11/2013 | Chen | |
| 2014/0154892 | A1 | 6/2014 | Zantout et al. | |
| 2015/0062929 | A1 | 3/2015 | Mostoller et al. | |
| 2017/0082257 | A1 | 3/2017 | Yoon | |
| 2018/0145448 | A1 * | 5/2018 | Munch ..... | H01R 13/6275 |

* cited by examiner

CARD EDGE CONNECTOR FOR A LIGHTING MODULE

CROSS-REFERENCE TO RELATED APPLICATIONS

This application is a continuation of U.S. application Ser. No. 16/833,725, filed Mar. 30, 2020, which is a continuation of U.S. application Ser. No. 15/474,287, filed Mar. 30, 2017 (now U.S. Pat. No. 10,655,810), the entire contents of which are incorporated herein by reference.

FIELD OF THE INVENTION

This invention relates to a lighting module for a vehicle and, more particularly, to a card edge connector with a secondary lock used in the lighting module.

DESCRIPTION OF THE RELATED ART

In the field of lighting modules, at least one or a plurality of light sources are controlled by a printed circuit board (PCB). The at least one or a plurality of light sources may be mounted directly on the printed circuit board or at an area close to the printed circuit board with electrical connections or jumpers between the at least one or a plurality of light sources and the printed circuit board.

In order to power the at least one or a plurality of light sources and the printed circuit board, a connector is used to couple the printed circuit board to the network, such as the UN or CAN network of the vehicle and a power source. Oftentimes, the connectors are female connectors that mate with a corresponding male connector integrally formed in the printed circuit board.

One significant problem in the prior art, especially with electrical connectors, commonly referred to as card edge connectors, is that they are electrically connected to a male connector at the edge of a printed circuit board. It is not uncommon that these card edge connectors become unconnected from the printed circuit board during installation or even normal use.

What is need, therefore, is an improved system for locking the card-edge connector to the printed circuit board, particularly for a lighting module that utilizes that light emitting diodes (LEDs).

SUMMARY OF THE INVENTION

It is therefore, a primary object of the invention to provide a card edge connector that is adapted to lock to a component of a lighting module, such as a heat sink, plastic bezel, housing or the like, in order to lock the connector to the printed circuit board, thereby maintaining a solid electrical connection therebetween.

Another object of the invention is to provide a card edge connector having at least one or a plurality of wings that cooperate with a mating wall of a heat sink, bezel, housing or the like in order to lock the card edge connector to the mating connector of the printed circuit board.

Another object of the invention is to provide a card edge connector having at least one or plurality of wings adapted to lock the card edge connector to a mating connector on the printed circuit board to ensure that the connector does not disengage from the printed circuit board due to vibration, shock or the like.

Another object of the invention is to provide a connector that has a lock, but that permits removal and disconnection of the card edge connector from the printed circuit board for serviceability.

Another object of the invention is to provide a card edge connector with at least one secondary lock.

Yet another object of the invention is to provide a card edge connector that is vibration resistant and ensures good connection at all times between the card edge connector and a printed circuit board.

Still another object of the invention is to provide a card edge connector that is easily removed for serviceability of the connector or the printed circuit board to which it is connected.

Another object of the invention is to provide a connector having a plurality of resilient arms that lock and hold the connector in a fully engaged position with the printed circuit board.

Still another object of the invention is to provide a card edge connector in a fully engaged position with the printed circuit board.

Still another object of the invention is to provide a card edge connector that has a plurality of resilient arms or wings present on at least one or a plurality of surfaces of the card edge connector in order to lock and hold the card edge connector in a fully engaged position with the printed circuit board.

In one aspect, one embodiment of the invention comprises a connector for a light module, the connector comprising a body having at least one arm, and the at least one arm having at least one detent for locking the connector to a component of the lighting module when the connector is mounted onto a printed circuit board.

In another aspect, another embodiment of the invention comprises a lamp assembly for a vehicle, the lamp assembly comprises a housing; a reflector mounted in the housing; at least one light source operatively associated with the reflector; a printed circuit board mounted on a component of the lamp assembly and being coupled to the at least one light source, the printed circuit board controlling an operation of the at least one light source; the printed circuit board having a first connector for coupling to a second connector, the second connector comprising a body having a plurality of resilient or elastic arms, each of the plurality of resilient or elastic arms having at least one detent for locking the connector to the component and retaining the connector in electrical contact with the printed circuit board.

This invention, including all embodiments shown and described herein, could be used alone or together and/or in combination with one or more of the features covered by one or more of the following list of features:

- The connector wherein the body comprises a plurality of arms, each having at least one detent for locking the connector to the component and retaining the connector in electrical contact with the printed circuit board.
- The connector wherein the at least one arm is resilient or elastic such that when the connector is connected to the printed circuit board, the at least one arm is deflected or cammed toward the body and when the connector becomes mounted on the printed circuit board, the at least one arm being biased to a locked position whereupon the at least one detent can engage a surface of the component to lock the connector to the printed circuit board.
- The connector wherein each of the plurality of arms is resilient or elastic such that when the connector is connected to the printed circuit board, the plurality of arms are deflected or cammed toward the body and when the connector becomes connected to the printed circuit board, the plurality of arms are biased to a locked position whereupon the at least one detent can engage a surface of the component to lock the connector to the printed circuit board.

The connector wherein each of the at least one detent comprises a shoulder or step integrally formed in the at least one arm and adapted to define the at least one detent that engages a surface of the component in order to retain the connector in a locked position on the printed circuit board.

The connector wherein each of the at least one detents comprises a shoulder or step integrally formed in the at least one arm and adapted to engage a surface of the component in order to retain the connector in a locked position on the printed circuit board.

The connector wherein the at least one arm comprises a first end that is integrally or monolithically formed in the body and a free end adapted to move towards and away from the body, the at least one detent being generally located between the first end and the free end.

The connector wherein each of the plurality of arms comprises a first end that is integrally or monolithically formed in the body and a free end adapted to move towards and away from the body, the at least one detent on each of the plurality of arms each being generally located between the first end and the free end.

The connector wherein each of the plurality of arms is dimensioned such that they extend beyond a mounting surface of the component so that they can be accessed and actuated toward the body when it is desired to disconnect the connector from the printed circuit board.

The connector wherein the component is at least one of a heat sink, a headlamp bezel, or a headlamp housing.

The connector wherein the component is at least one of a heat sink, a headlamp bezel, or a headlamp housing.

The lamp assembly wherein each of the plurality of resilient or elastic arms is resilient or elastic such that when the second connector is moved toward the printed circuit board, the plurality of resilient or elastic arms are deflected or cammed toward the body and when the second connector is moved towards becomes connected to the printed circuit board, the plurality of resilient or elastic arms are return to a locked position whereupon the at least one detent can engage a surface of the component to lock the second connector to the printed circuit board.

The lamp assembly wherein each of the at least one detents comprises a shoulder or step integrally formed in the plurality of resilient or elastic arm and adapted to engage a surface of the component in order to retain the second connector in a locked position on the printed circuit board.

The lamp assembly wherein each of the plurality of resilient or elastic arms comprises a first end that is integrally or monolithically formed in the body, and a free end adapted to move towards and away from the body, the at least one detent on each of the plurality of resilient or elastic arms each being generally located between the first end and the free end.

The lamp assembly wherein each of the plurality of resilient or elastic arms is dimensioned such that they extend beyond a mounting surface of the component so that they can be accessed and moved toward the body when it is desired to disconnect the second connector from the printed circuit board.

The lamp assembly wherein the component is at least one of a heat sink; a headlamp bezel, or a headlamp housing.

The lamp assembly wherein the component is a heat sink having the at least one light source and the printed circuit board mounted thereon, the heat sink having a mounting wall that defines an aperture for receiving the second connector the mounting wall providing a locking surface that deflects the arms towards the body when the connector is moved toward the printed circuit board and also engages and cooperates with each of the detents of the plurality of resilient or elastic arms to lock the connector to the printed circuit board.

The lamp assembly wherein each of the plurality of resilient or elastic arms comprises a free end that extends beyond the mounting wall so that the free ends can be actuated to unlock the connector from the printed circuit board.

The lamp assembly wherein the lamp assembly is a headlamp assembly.

These and other objects and advantages of the invention will be apparent from the following description, the accompanying drawings and the appended claims.

DETAILED DESCRIPTION OF THE PREFERRED EMBODIMENTS

Figure 1:
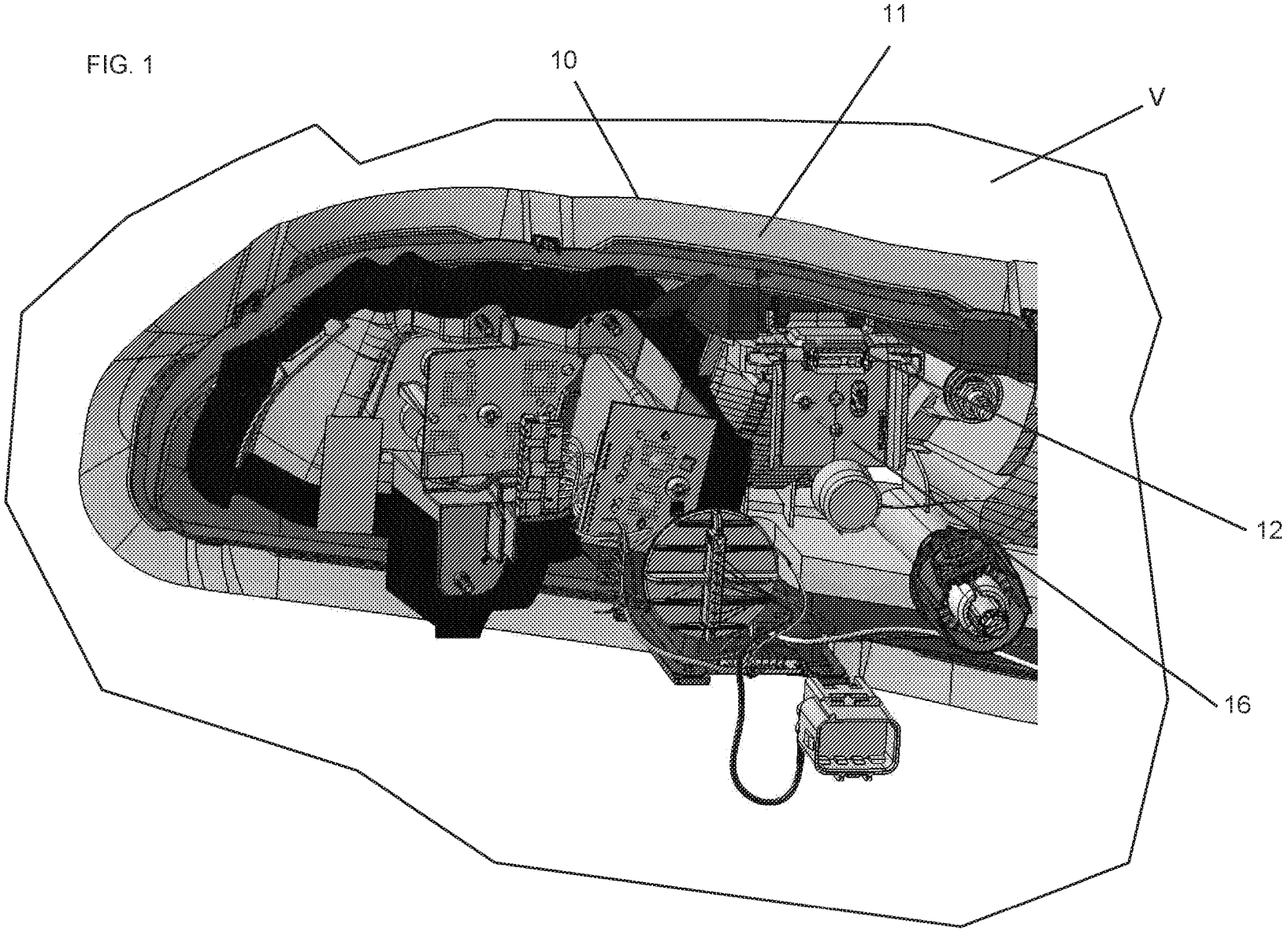
FIG. 1 is a fragmentary view of a light module assembly mounted on a vehicle, with the light module assembly having a connector in accordance with one embodiment of the invention.
Figure 2:
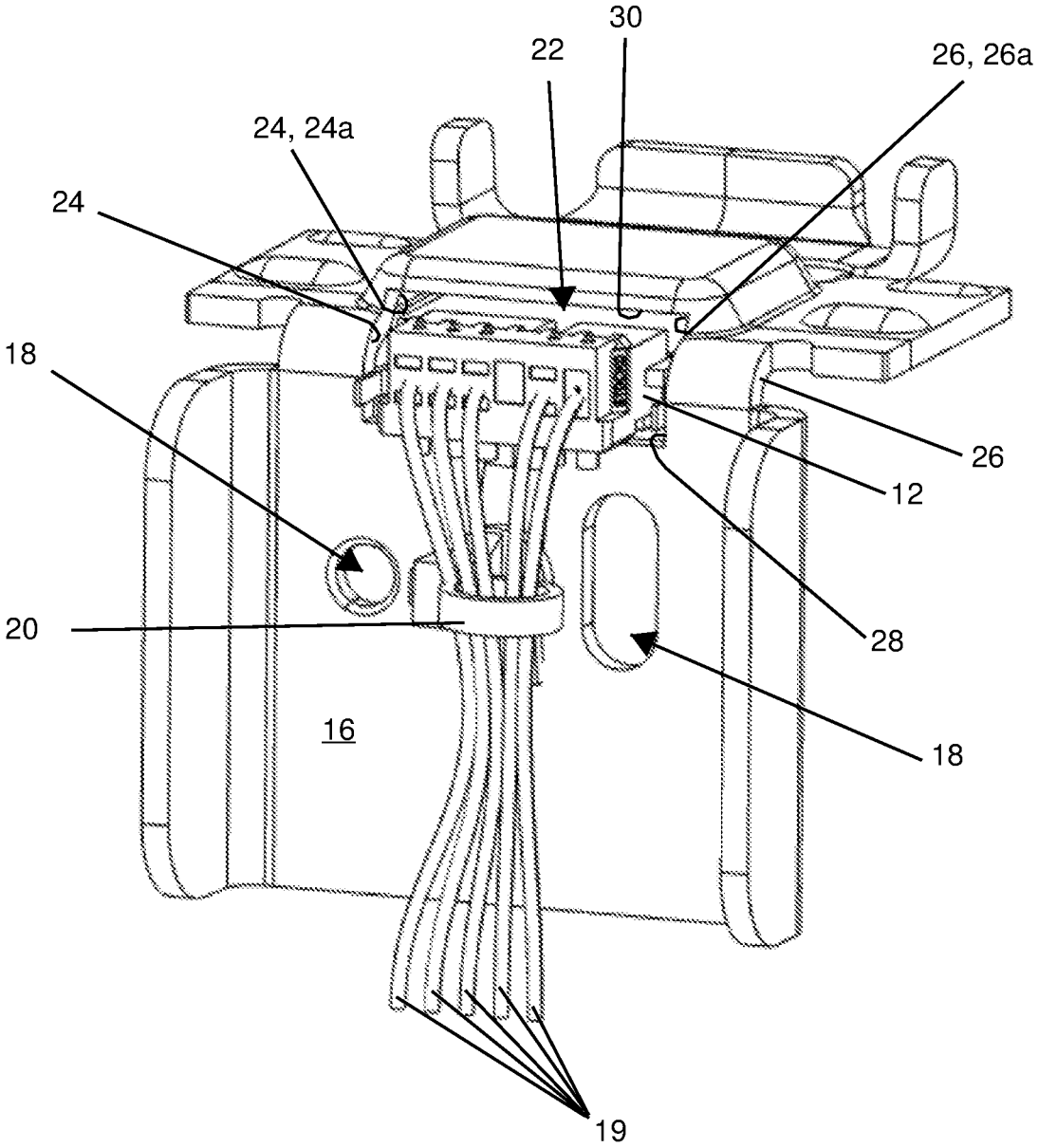
FIG. 2 is a perspective view of a heat sink having a printed circuit board coupled to a connector in accordance with one embodiment of the invention.

FIG. 1 illustrates a lighting module assembly 10 installed on a vehicle V. The lighting module assembly 10 comprises a housing, a reflector (not shown) mounted in the housing, at least one light source (not shown), a heat sink and a printed circuit board or PCB, described later herein, for controlling operation of the at least one light source. The lighting module assembly 10 has a card edge connector 12 that is mounted to a bracket or heat sink 16. The card edge connector 12 comprises a plurality of wires or conductors 19 (FIG. 2) that are coupled to a power source and other components (not shown) of the vehicle V. It should be appreciated that for ease of illustration the plurality of wires or conductors 19 coupled to the connector 12 are not shown in FIGS. 3-6.

Referring now to FIGS. 2-6, various features of the embodiment will now be described. The bracket or heat sink 16 comprises a plurality of apertures 18 (FIG. 3) that are adapted to receive hardware such as a wire harness clip 20 (FIG. 2) or at least one fastener, such as a screw (not shown), for mounting the bracket onto a support 11 of the lighting module assembly 10.

Note that the bracket or heat sink 16 comprises a connector receiving area or aperture 22 that is defined by a first wall 24, a second wall 26, a third wall 28 and a fourth wall 30. The walls 24-30 cooperate to define the connector receiving area or aperture 22, which provides access to a male connector 31*a* of a printed circuit board 31 that is received in a female opening or slot 12*a* (FIGS. 6 and 7) of the card edge connector 12. The female slot or opening 12*a* (FIG. 7) is adapted and sized to receive and secure the connector 12 to the male connector 31*a* of the printed circuit board 31.

Figure 3:
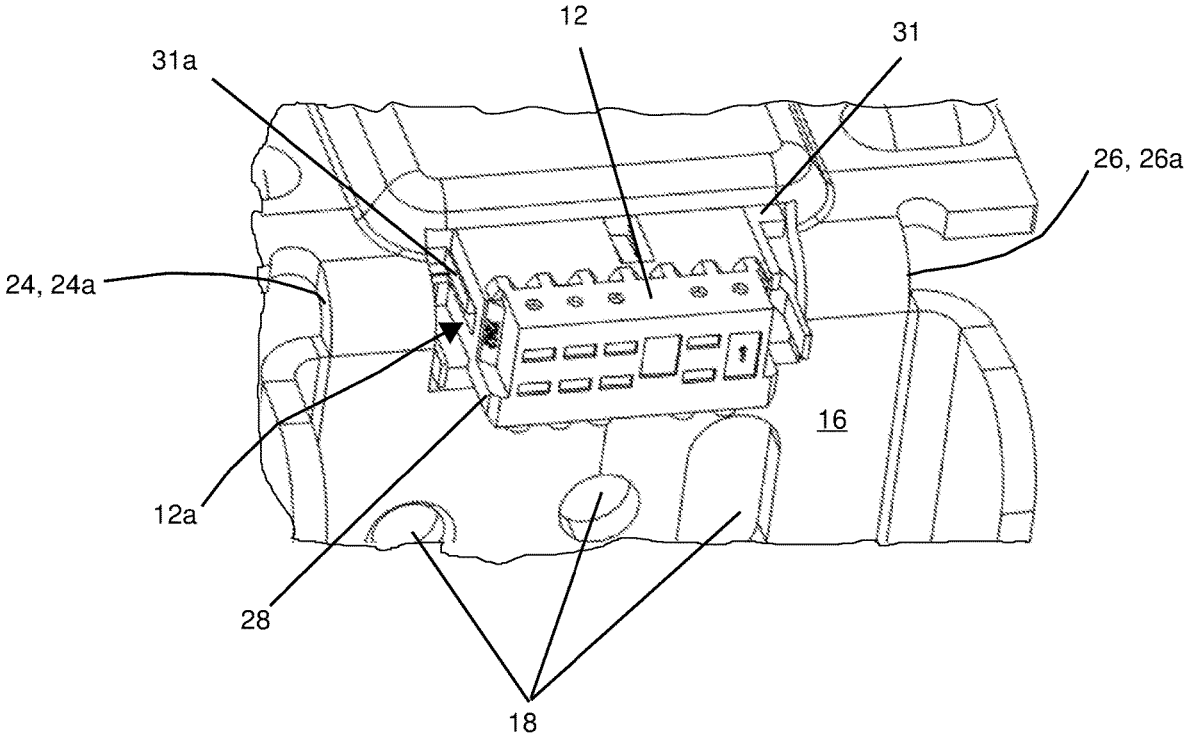
FIG. 3 is a fragmentary enlarged view showing the connector electrically connected to a printed circuit board and mounted to a bracket or heat sink which is secured to a support, such as a housing or a bezel in the light module assembly.
Figure 4:
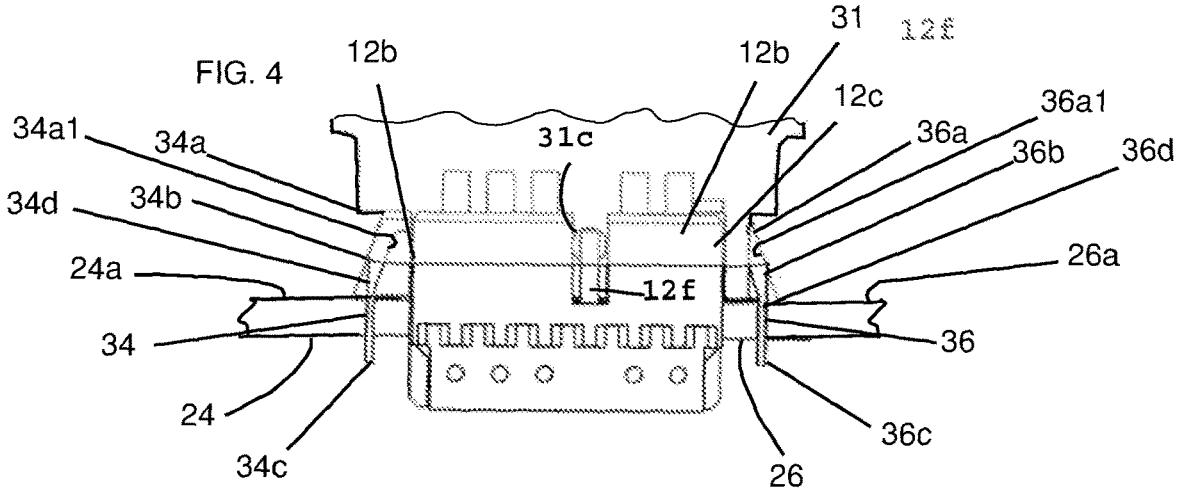
FIG. 4 is a fragmentary view showing details of the embodiment shown in FIG. 2.
Figure 5:
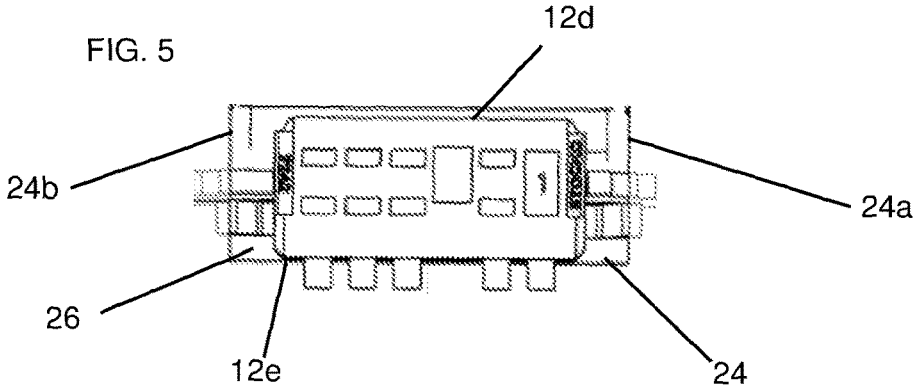
FIG. 5 is an end view of the embodiment shown in FIG. 4.

As best illustrated in FIG. 3, the first wall 24 comprises a first wall edge or surface 24*a* and the second wall 26 comprises the second wall edge or surface 26*a* as shown. The connector 12 comprises at least one or a plurality of resilient arms or wings 34 and 36 (FIG. 4). The first arm or wing 34 comprises a first end 34*a* integrally formed in the connector 12 of the connector 12, a detent end 34*b* and a joining portion 34*c* which joins the first end 34*a* to the detent end 34*b*. Likewise, the second arm or wing 36 comprises a first end 36*a*, a detent end 36*b* and a joining portion 36*c* for joining the first end 36*a* to the detent end 34*b*.

Figure 8A:
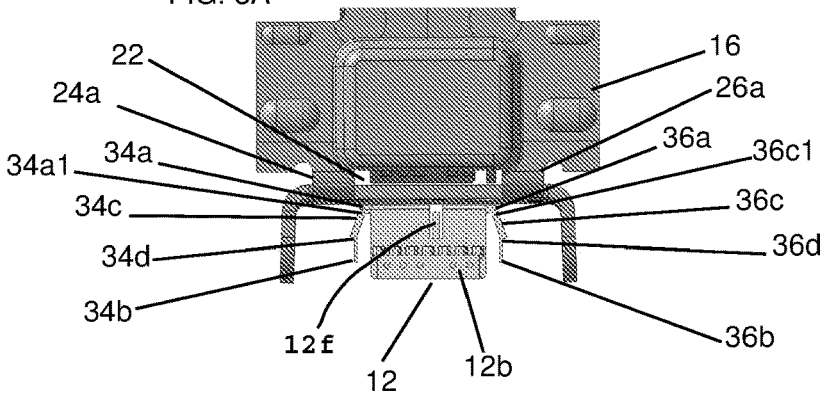
FIGS. 8A-8C are various views showing a connector with at least one or a plurality of resilient arms in accordance with one embodiment of the invention illustrating the connector mounted on the printed circuit board at various stages of mounting and locking of the connector onto the heat sink.
Figure 8B:
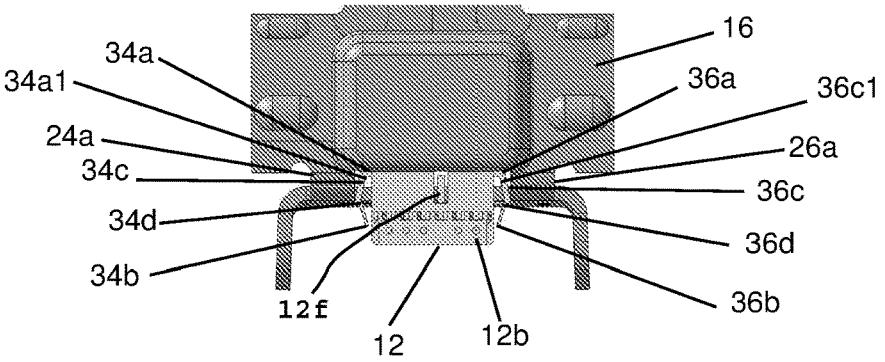
Figure 8C:
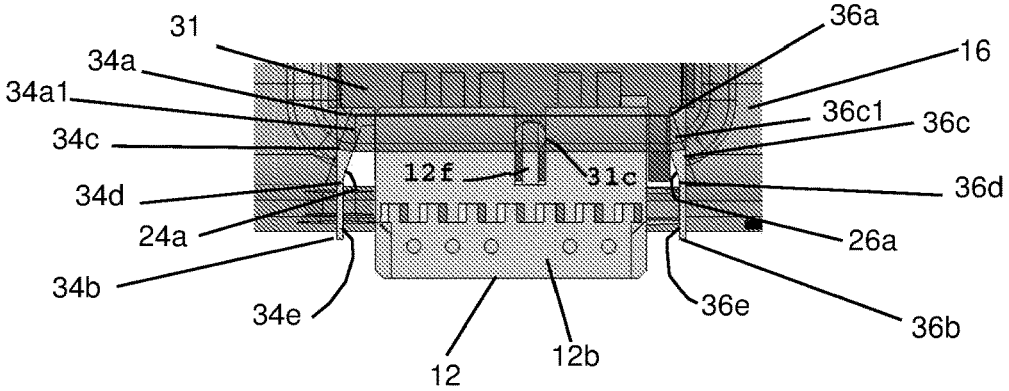

In the illustration being described, the detent ends 34*b* and 36*b* of the first resilient arm 34 and second resilient arm 36, respectively, each comprise a shoulder, step or detent 34*d* and 36*d*, respectively that is integrally or monolithically formed in the first resilient arm 34 and second wing or arm 36, respectively. As best illustrated in FIGS. 8A-8C, note that when the connector 12 is inserted in the direction of arrow A into in the aperture 22 of the heat sink 16 and toward the printed circuit board 31, the first and second arms or wings 34 and 36 are deflected or cammed inward as best shown in FIG. 8B. As the connector 12 is gradually inserted into the aperture 22 of the heat sink 16, the angled surface 34*a*1 (FIGS. 8A-8C) of the first end 34*a* engages a first wall edge or surface 24*a* of wall 24. Likewise, the surface 36*cl* of the portion 36*c* engages the first wall edge or surface 26*a* of the wall 26, as best illustrated in FIGS. 8A-8C.

Figure 6:
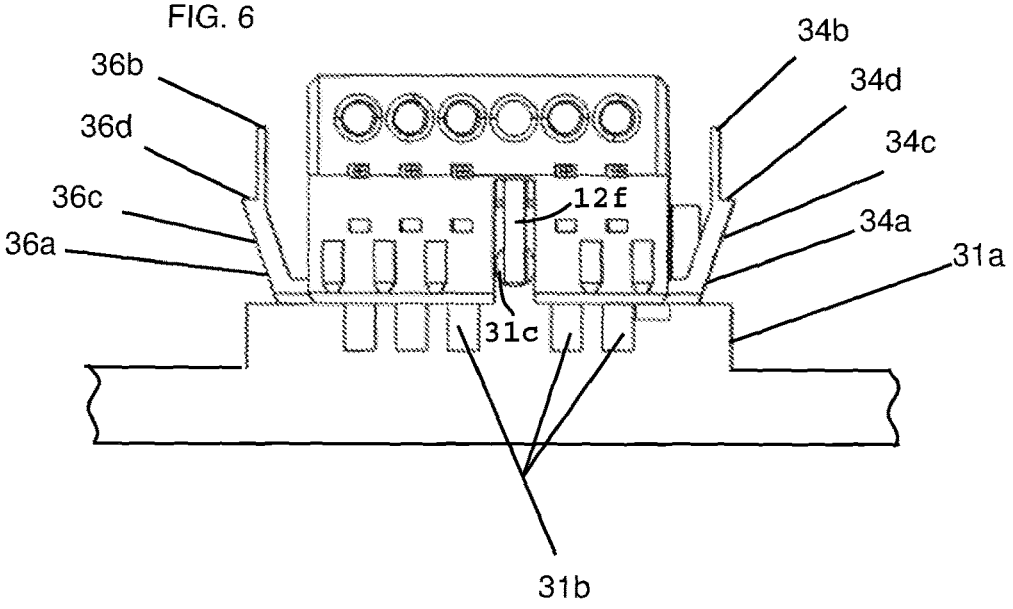
FIG. 6 is a plan view, without the heat sink, showing a relationship of the connector and printed circuit board.
Figure 7:
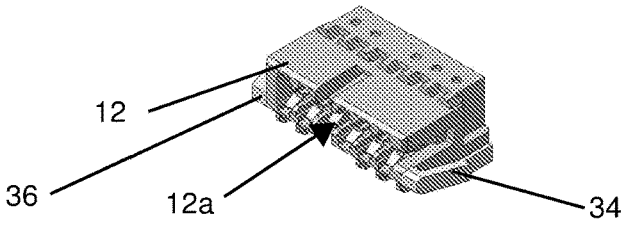
FIG. 7 is a perspective view of the connector in accordance with one embodiment of the invention.

As the connector 12 is inserted into the aperture 22, the male connector 31*a* (FIG. 6) of the printed circuit board 31 is received in the female opening or slot 12*a* of connector body 12*b*. The arms 34 and 36 are elastic and resilient and deflect inwardly toward the connector 12. After the shoulder, step or detents 34*a* and 36*d* clear the walls or surfaces 24*a* and 26*a*, the arms 34 and 36 return to move away from the connector 12 and the shoulders, steps or detents 34*d* and 36*d* become opposed to the walls or surface 24*a* and 26*a*, respectively, as illustrated in FIG. 6, thereby locking the connector 12 to the heat sink 16 and the printed circuit board 31.

As shown in FIG. 8C, a portion 34*e* and 36*e* of the ends 34*a* and 36*a*, respectively, of the first and second resilient arms or wings 34 and 36 extend beyond the surfaces 24*b* and 26*b* (FIG. 4) in order to enable these arms or wings 34 and 36 to be moved inwardly toward the connector 12 when it is desired to unlock and remove the connector 12 from the printed circuit board 31, for example, if either the connector 12 or the printed circuit board 31 needs servicing.

The connection between the connector 12 and the male connector 31*a* provides or defines a primary lock. In FIGS. 4, 6 and 8*a*-8*c*, a primary connecting element includes protrusion 12*f* attached to the body 12*b*, which engages receiving portion 31*c* shown as an opening in PCB 31 in FIGS. 4, 6 and 8*c*. Advantageously, the embodiment being described provides a secondary lock for connecting the connector 12 to the printed circuit board 31 and for maintaining a locked connection between the connector 12 and the printed circuit board 31. The embodiment also provides convenient means for disconnecting the connector 12 from the printed circuit board 31 for serviceability.

The first resilient wing or arm 34 and second resilient wing or arm 36 are situated at opposing ends or sides 12*b* and 12*c* of the connector 12, and it should be appreciated that fewer arms or wings 34, 36 may be used. For example, a single arm or wing 34 or 36 may be used, or alternatively, a plurality of resilient arms or wings, such as the first and second arms or wings 34 and 36 may be used. For example, additional arms or wings 34, 36 may be placed on the edges 12*d* and 12*e* (FIG. 5) if desired or the first and second resilient arms or wings 34 and 36 may be associated with or integrally or monolithically formed with those surfaces, rather than or in addition to the arms or wings 34, 36 associated with the sides 12*b* and 12*c*.

Advantageously, the embodiment described herein provides a built in secondary lock that connects directly to the printed circuit board 31 and facilitates or ensures maintaining a good connection between the conductors of the connector 12 and the conductors 31*b* (FIG. 6) of the printed circuit board 31, for example during vibration. Note that the features of the embodiment being described could also be used in an embodiment wherein the connector 12 is a male connector (not shown) that is received in a female slot (not shown) on the printed circuit board 31.

This invention, including all embodiments shown and described herein, could be used alone or together and/or in combination with one or more of the features covered by one or more of the claims set forth herein, including but not limited to one or more of the features or steps mentioned in the Summary of the Invention and the claims.

While the system, apparatus and method herein described constitute preferred embodiments of this invention, it is to be understood that the invention is not limited to this precise system, apparatus and method, and that changes may be made therein without departing from the scope of the invention which is defined in the appended claims.

The invention claimed is:

1. A connector of a light module of a vehicle, the connector comprising:

a body;

a primary connecting element comprising a protrusion attached to the body and configured to engage a receiving portion formed in a printed circuit board when the body of the connector is mated to an edge of the printed circuit board; and a secondary connecting element attached to the body and configured to lock the connector to a separate component of the light module when the body of the connector is mated to the edge of the printed circuit board, wherein the secondary connecting element comprises at least one deflectable arm that is configured to deflect during the action of locking the connector to the edge of the printed circuit board and can be manually deflected to disconnect the connector from the edge of the printed circuit board.

2. The connector as recited in claim 1, wherein the at least one deflectable arm includes a plurality of arms each one of the plurality of arms having at least one detent that is configured to reversibly-lock the connector to the component of the light module and retain the connector in electrical contact with the printed circuit board.

3. The connector as recited in claim 2, wherein each one of the plurality of arms is dimensioned such that they extend beyond a visible surface of the wall of the component of the light module so that they can be accessed and actuated toward the body when it is desired to disconnect the connector from the the printed circuit board.

4. The connector as recited in claim 2, wherein the component of the light module is at least one of a heat sink, a headlamp bezel, or a headlamp housing.

5. The connector as recited in claim 1, wherein the at least one deflectable arm is resilient or elastic such that when the connector is connected to the printed circuit board, the at least one arm is cammed toward the body, and when the connector becomes connected to the printed circuit board, the at least one arm is biased away from the body to a locked position.

6. The connector as recited in claim 1, wherein each of the at least one deflectable arms comprises a shoulder or a step integrally formed in the at least one arm and adapted to define the at least one detent that engages a hidden surface of a wall of the component of the light module in order to retain the connector in a locked position relative to the printed circuit board.

7. The connector as recited in claim 1, wherein each deflectable arm comprises a first end attached to the body and a second end distal to the first end, the second end being a free end adapted to move towards and away from the body during connection and disconnection of the connector with the printed circuit board.

8. The connector as recited in claim 1, wherein the component of the light module is at least one of a heat sink, a headlamp bezel, or a headlamp housing.

9. The connector as recited in claim 1, wherein, when the body of the connector is connected to the mounting connections of the printed circuit board, the body of the connector is at least partially surrounded by the component of the light module.

10. A lamp assembly of a vehicle, the lamp assembly comprising:

a housing;

a reflector mounted in the housing;

at least one light source operatively associated with the reflector; and a printed circuit board mounted on a component of the lamp assembly and coupled to the at least one light source, the printed circuit board controlling an operation of the at least one light source, a surface of the printed circuit board facing an opening of the component of the lamp assembly, wherein the printed circuit board has, disposed on the surface of the printed circuit board, a first connector for coupling to a second connector, and a receiving portion formed in a surface of the printed circuit board adjacent to the first connector, the second connector including:

a body;

a primary connecting element comprising a protrusion attached to the body and configured to engage the receiving portion formed in the printed circuit board when the body of the first connector is mated to the second connector; and a secondary connecting element attached to the body and configured to lock the second connector to the component of the lamp assembly when the second connector is mated to the first connector, wherein the secondary connecting element comprises at least one deflectable arm that is configured to deflect during the action of locking the second connector to the first connector and can be manually deflected to disconnect the second connector from the printed circuit board.

11. The lamp assembly as recited in claim 10, wherein the at least one deflectable arm comprises a plurality of arms each being resilient or elastic such that:

when the second connector is moved toward the first connector of the printed circuit board, the plurality of arms are cammed toward the body, and when the second connector is connected to the first connector of the printed circuit board, the plurality of arms are moved to a locked position whereupon at least one detent engages a hidden surface of the wall of the component of the lamp assembly to reversibly-lock the second connector to the printed circuit board.

12. The lamp assembly as recited in claim 10, wherein each of the at least one deflectable arms includes a shoulder or a step integrally formed in the respective arm adapted to engage a hidden surface of a wall of the component of the lamp assembly in order to retain the second connector in a locked position on the printed circuit board.

13. The lamp assembly as recited in claim 10, wherein each of the at least one deflectable arms comprises a first end attached to the body, and a second end distal from the first end, wherein the second end is a free end adapted to move towards and away from the body during connection and disconnection of the second connector with the first connector of the printed circuit board.

14. The lamp assembly as recited in claim 10, wherein each of the at least one arm is dimensioned such that it extends beyond a visible surface of a wall of the component of the lamp assembly so that each arm an be accessed and moved toward the body when it is desired to disconnect the second connector from the first connector of the printed circuit board.

15. The lamp assembly as recited in claim 10, wherein the component of the lamp assembly is at least one of a heat sink, a headlamp bezel, or a headlamp housing.

16. The lamp assembly as recited in claim 10, wherein the component of the lamp assembly is a heat sink having the at least one light source and the printed circuit board mounted thereon, the opening of the heat sink defining a mounting wall, the mounting wall providing a contacting surface that deflects the at least one deflectable arm towards the body when the second connector is moved toward the first connector of the printed circuit board, and a hidden surface that engages at least one detent of the arm to reversibly-lock the second connector to the printed circuit board.

17. The lamp assembly as recited in claim 16, wherein the second end is a free end that extends beyond the mounting wall so that the free end can be actuated to unlock the second connector from the printed circuit board.

18. The lamp assembly as recited in claim 10, wherein the lamp assembly is a headlamp assembly.

19. The lamp assembly as recited in claim 10, wherein, when the second connector is in electrical contact with the first connector of the printed circuit board via mounting connections, the second connector is at least partially surrounded by the component of the lamp assembly.

20. A connector of a light module of a vehicle, the connector comprising:

a body;

means for locking the connector to a printed circuit board when the body of the connector is mated to an edge of the printed circuit board; and a connecting element attached to the body and configured to lock the connector to a separate component of the light module when the body of the connector is mated to the edge of the printed circuit board, wherein the connecting element comprises at least one deflectable arm that is configured to deflect during the action of locking the connector to the edge of the printed circuit board and can be manually deflected to disconnect the connector from the edge of the printed circuit board.

* * * * *